US007959367B2

(12) United States Patent
Mushimoto

(10) Patent No.: US 7,959,367 B2
(45) Date of Patent: Jun. 14, 2011

(54) IMAGE GENERATING APPARATUS

(75) Inventor: Atsushi Mushimoto, Daito (JP)

(73) Assignee: Funai Electric Co., Ltd., Daito-shi, Tokyo ( * ) Notice: Subject to any disclaimer, the term of this patent is extended or adjusted under 35 U.S.C. 154(b) by 647 days.

(21) Appl. No.: 11/681,366

(22) Filed: Mar. 2, 2007

(65) Prior Publication Data

US 2007/0206082 A1 Sep. 6, 2007

(30) Foreign Application Priority Data

Mar. 3, 2006 (JP) ..... 2006-057369

(51) Int. Cl.
*B41J 33/14* (2006.01)

(52) U.S. Cl. ..... 400/234; 400/208; 400/223

(58) Field of Classification Search ..... 400/234
See application file for complete search history.

(56) References Cited

U.S. PATENT DOCUMENTS

| | | | | | |
|---|---|---|---|---|---|
| 4,449,837 | A | * | 5/1984 | Craft | 400/208 |
| 4,468,139 | A | * | 8/1984 | Hattori | 400/234 |
| 4,764,041 | A | * | 8/1988 | Bierhoff | 400/234 |
| 4,924,242 | A | * | 5/1990 | Fukawa | 400/234 |
| 5,622,440 | A | * | 4/1997 | Yamamoto et al. | 400/234 |
| 5,709,488 | A | * | 1/1998 | Imai et al. | 400/234 |
| 5,820,279 | A | * | 10/1998 | Lodwig et al. | 400/234 |

FOREIGN PATENT DOCUMENTS

| | | | |
|---|---|---|---|
| JP | 2002-187322 | A | 7/2002 |
| JP | 2005-199520 | A | 7/2005 |

* cited by examiner

*Primary Examiner* — Jill E Culler
(74) *Attorney, Agent, or Firm* — Crowell & Moring LLP

(57) ABSTRACT

An image generating apparatus capable of inhibiting a take-up member from falling without separately providing a stop member is obtained. This image generating apparatus includes a take-up member for taking up an ink sheet, including a spring mount portion, a rotary shaft rotatably inserted into the take-up member, a spring member for regulating the take-up member to rotate only in a take-up direction, mounted on the spring mount portion of the take-up member, and a spring engaging portion engaged with a first end of the spring member. The spring mount portion of the take-up member is integrally provided with a stop portion for inhibiting the spring member from falling.

14 Claims, 9 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a take-up member for taking up an ink sheet, including a spring mount portion, and a spring member for regulating the take-up member to rotate only in a prescribed direction, mounted on the spring mount portion of the take-up member.

2. Description of the Background Art

An image generating apparatus comprising a take-up member for taking up an ink sheet, including a spring mount portion, and a spring member for regulating the take-up member to rotate only in a prescribed direction, mounted on the spring mount portion of the take-up member is known in general, as disclosed in Japanese Patent Laying-Open No. 2005-199520, for example.

In a take-up member described in the aforementioned Japanese Patent Laying-Open No. 2005-199520, a spring member for regulating the take-up member to rotate only in a prescribed direction is wound around an outer circumference of the take-up member rotatably mounted on a rotary shaft. A first end of the spring member is mounted on a frame of the image generating apparatus. The take-up member is fixed in a shaft direction of the rotary shaft by a plurality of retaining rings, to inhibit the take-up member from falling from the rotary shaft. In this Japanese Patent Laying-Open No. 2005-199520, in a case where the take-up member tries to rotate in an opposite direction to the prescribed direction, a spring diameter of the spring member is reduced due to frictional force between the take-up member and the spring member, whereby the take-up member is fastened by the spring member. Thus, the take-up member is inhibited from rotating in the opposite direction to the prescribed direction.

Various structures comprising a spring member regulating a prescribed member to rotate only in a prescribed direction are know in general, as disclosed in Japanese Patent Laying-Open No. 2002-187322, for example.

The aforementioned Japanese Patent Laying-Open No. 2002-187322 discloses a print head unit comprising a sleeve integrally rotating with a print head, a spring member wound around the sleeve and regulating the print head to rotate only in a prescribed direction, and a case for storing the sleeve and the spring member. In this print head unit according to Japanese Patent Laying-Open No. 2002-187322, a first end of the spring member is fitted in a groove of the case of the print head unit. In a case where the print head and the sleeve integrally rotating with the print head rotate in an opposite direction to the prescribed direction, a spring diameter of the spring member is reduced due to frictional force between the sleeve and the spring member, thereby fastening the sleeve. Thus, in Japanese Patent Laying-Open No. 2002-187322, the sleeve and the print head integrally rotating with the sleeve are inhibited from rotating in the opposite direction to the prescribed direction.

However, the aforementioned take-up member described in Japanese Patent Laying-Open No. 2005-199520 is provided with a retaining ring for inhibiting the take-up member from falling from the rotary shaft, and therefore a stop member (retaining ring) is disadvantageously separately required.

The aforementioned print head unit described in Japanese Patent Laying-Open No. 2002-187322 is not fixed to the rotary shaft, and therefore the print head unit disadvantageously falls from the image generating apparatus. Thus, in a case where the aforementioned structure of the print head unit in Japanese Patent Laying-Open No. 2002-187322 is employed for regulating the rotation of the take-up member for taking up an ink sheet, the take-up member disadvantageously falls.

SUMMARY OF THE INVENTION

The present invention has been proposed in order to solve the aforementioned problems, and an object of the present invention is to provide an image generating apparatus capable of inhibiting a take-up member from falling without separately providing a stop member.

In order to attain the aforementioned object, an image generating apparatus according to a first aspect of the present invention comprises a take-up member for taking up an ink sheet, including a spring mount portion, a rotary shaft rotatably inserted into the take-up member, a spring member for regulating the take-up member to rotate only in a take-up direction, mounted on the spring mount portion of the take-up member, and a spring engaging portion engaged with a first end of the spring member, wherein the spring mount portion of the take-up member is integrally provided with a stop portion for inhibiting the spring member from falling.

In the image generating apparatus according to the first aspect, as hereinabove described, the spring member for regulating the take-up member to rotate only in the take-up direction is mounted on the spring mount portion of the take-up member, and the spring engaging portion engaged with the first end of the spring member is provided, and a stop portion for inhibiting the spring member from falling is provided on the spring mount portion of the take-up member. Thus, when the take-up member mounted with the spring member tries to move in a falling direction from the rotary shaft, the engagement of the first end of the spring member with the spring engaging portion can inhibit the spring member from moving in a falling direction of the take-up member and the stop portion can inhibit the spring member from falling from the spring mount portion of the take-up member, whereby the take-up member mounted with the spring member can be inhibited from falling from the rotary shaft. In addition, the stop portion is integrally provided with the spring mount portion, whereby the take-up member can be inhibited from falling from the image generating apparatus without separately providing a stop member such as a retaining ring.

In the image generating apparatus according to the aforementioned first aspect, a first end of the rotary shaft is preferably mounted on a shaft fixing portion, and the stop portion of the spring mount portion preferably includes a circumferential rib provided on an outer circumference of the spring mount portion of the take-up member closer to the shaft fixing portion. According to this structure, when the take-up member mounted with the spring member tries to move in a falling direction from the rotary shaft, the circumferential rib can easily inhibit the spring member from falling from the take-up member.

In the image generating apparatus according to the aforementioned first aspect, the first end of the spring member is preferably formed in a U-shape, and the U-shaped first end of the spring member is preferably engaged so as to be hooked onto the spring engaging portion. According to this structure, when the take-up member mounted with the spring member tries to move in a falling direction from the rotary shaft, the spring engaging portion can easily inhibit the spring member from moving in a falling direction of the take-up member.

In this case, the spring engaging portion preferably includes a concave notch, an open end of the concave notch is preferably provided with a guide portion having a notch width larger than a notch width of a bottom portion of the notch, and the spring member is preferably engaged with the spring engaging portion through the guide portion of the spring engaging portion. According to this structure, when the first end of the spring member is engaged with the concave notch of the spring engaging portion, the spring member can be easily engaged with the spring engaging portion by the guide portion so provided on the open end of the concave notch as to have the notch width lager than the notch width of the bottom portion of the notch.

The image generating apparatus according to the aforementioned first aspect preferably further comprises a motor driving the take-up member, and a motor bracket mounted with the motor and including the spring engaging portion and a shaft fixing portion, wherein a first end of the rotary shaft is preferably mounted on the shaft fixing portion. According to this structure, the motor bracket can be used as a member for mounting the rotary shaft and the first end of the spring member, whereby no members for mounting the rotary shaft and for mounting the first end of the spring member may be separately provided.

In the aforementioned structure comprising the motor bracket, the spring engaging portion preferably includes an edge portion of the motor bracket, the first end of the spring member is preferably formed in a U-shape, and the U-shaped first end of the spring member is preferably inserted into a notch of the spring engaging portion provided in the motor bracket, while a forward end is preferably engaged so as to be hooked onto the edge portion of the motor bracket. According to this structure, the first end of the spring member can be easily engaged with the motor bracket.

In the aforementioned structure comprising the motor bracket, the first end of the spring member is preferably bent at two points of a first bent portion and a second bent portion closer to a forward end than the first bent portion to be formed in a U-shape, and an interval between the first bent portion and the second bent portion is preferably formed to be substantially equal to an interval between a notch of the motor bracket and the edge portion. According to this structure, a portion from the first bent portion of the spring member to the second bent portion can be brought in close contact with a portion from the notch of the motor bracket to the edge portion, and the portion from the second bent portion to the forward end can be mounted so as to be hooked onto the edge portion. Thus, the first end of the spring member can be inhibited from wobbling with respect to the motor bracket.

In the aforementioned structure comprising the motor bracket, the first end of the spring member is preferably formed in a U-shape, the U-shaped first end of the spring member is preferably engaged so as to be hooked onto the spring engaging portion, the motor bracket preferably includes a wall surface portion extending in a direction intersecting with a direction in which the first end of the spring member protrudes from the take-up member, and the spring engaging portion is preferably provided in the wall surface portion. According to this structure, the U-shaped first end of the spring member can be easily engaged so as to be hooked onto the wall surface portion dissimilarly to a case where the spring engaging portion is provided at a portion in the motor bracket, extending in a direction parallel to a direction in which the first end of the spring member protrudes from the take-up member.

In the aforementioned structure in which the notch of the spring engaging portion is provided with the guide portion, the guide portion is preferably so formed that a notch width is gradually increased from the bottom portion of the notch toward the open end of the notch. According to this structure, the first end of the spring member inserted into the open end with the large notch width is guided by the guide portion to reach the bottom portion with the small notch width. Thus, the spring member can be easily engaged with the spring engaging portion.

In the image generating apparatus according to the aforementioned first aspect, the take-up member preferably further includes a gear member rotated by driving force of the motor, a rotating member for taking up the ink sheet by rotation following rotation of the gear member and an intervening member arranged between the gear member and the rotating member in order to interrupt transmission of rotation of the gear member to the rotating member in a case where a prescribed load torque or more is applied to the rotating member, the gear member, the rotating member and the intervening member preferably constitute a torque limiter, and the spring mount portion is preferably so formed as to integrally rotate with the gear member. According to this structure, the spring mount portion and the spring member can inhibit the take-up member from rotating an opposite direction from the take-up direction, and the torque limiter constituted by the gear member, the rotating member and the intervening member can inhibit an load from being applied to the ink sheet in a case where the take-up member rotates in the take-up direction.

An image generating apparatus according to a second aspect of the present invention comprises a take-up member for taking up an ink sheet, including a spring mount portion, a rotary shaft rotatably inserted into the take-up member, a spring member for regulating the take-up member to rotate only in a take-up direction, mounted on the spring mount portion of the take-up member, a spring engaging portion engaged with a first end of the spring member, a motor driving the take-up member and a motor bracket mounted with the motor, wherein the spring mount portion of the take-up member is integrally provided with a stop portion for inhibiting the spring member from falling, a first end of the rotary shaft is mounted on a shaft fixing portion, the stop portion of the spring mount portion includes a circumferential rib provided on an outer circumference of the spring mount portion of the take-up member closer to the shaft fixing portion, the motor bracket includes the spring engaging portion and the shaft fixing portion, the first end of the spring member is formed in a U-shape, the U-shaped first end of the spring member is engaged so as to be hooked onto the spring engaging portion of the motor bracket, the spring engaging portion of the motor bracket includes a concave notch, and an open end of the concave notch is provided with a guide portion having a notch width larger than a notch width of a bottom portion of the notch, and the U-shaped first end of the spring member is engaged with the concave notch through the guide portion of the concave notch of the motor bracket.

In the image generating apparatus according to the second aspect, as hereinabove described, the spring member for regulating the take-up member to rotate only in the take-up direction is mounted on the spring mount portion of the take-up member, and the spring engaging portion engaged with the first end of the spring member is provided, and a stop portion for inhibiting the spring member from falling is provided on the spring mount portion of the take-up member. Thus, when the take-up member mounted with the spring member tries to move in a falling direction from the rotary shaft, the engagement of the first end of the spring member with the spring engaging portion can inhibit the spring member from moving in a falling direction of the take-up member and the stop portion can inhibit the spring member from falling from the spring mount portion of the take-up member, whereby the take-up member mounted with the spring member can be inhibited from falling from the rotary shaft. In addition, the stop portion is integrally provided with the spring mount portion, whereby the take-up member can be inhibited from falling from the image generating apparatus without separately providing a stop member such as a retaining ring.

The first end of the rotary shaft is mounted on the shaft fixing portion, and the circumferential rib is provided as the stop portion on the circumference of the spring mount portion of the take-up member closer to the shaft fixing portion, whereby the circumferential rib can easily inhibit the spring member from falling from the take-up member when the take-up member mounted with the spring member tries to move in a falling direction from the rotary shaft. The first end of the spring member is formed in a U-shape, and the U-shaped first end of the spring member is engaged so as to be hooked onto the spring engaging portion, whereby when the take-up member mounted with the spring member tries to move in a falling direction from the rotary shaft, the spring engaging portion can easily inhibit the spring member from moving in a falling direction of the take-up member. The spring engaging portion includes the concave notch, the open end of the concave notch is provided with the guide portion having the notch width larger than the notch width of the bottom portion of the notch, and the spring member is engaged with the spring engaging portion through the guide portion of the spring engaging portion, whereby, the spring member can be easily engaged with the spring engaging portion by the guide portion so provided on the open end of the concave notch as to have the notch width lager than the notch width of the bottom portion of the notch when the first end of the spring member is engaged with the concave notch of the spring engaging portion. The motor driving the take-up member is mounted, and the image generating apparatus further comprises the motor bracket including the spring engaging portion and the shaft fixing portion mounted with the first end of the rotary shaft, whereby the motor bracket can be used as a member for mounting the rotary shaft and the first end of the spring member, whereby no members for mounting the rotary shaft and for mounting the first end of the spring member may be separately provided.

In the image generating apparatus according to the aforementioned second embodiment, the spring engaging portion preferably includes an edge portion of the motor bracket, and the U-shaped first end of the spring member is preferably inserted into the notch of the spring engaging portion provided in the motor bracket, while a forward end is preferably engaged so as to be hooked onto the edge portion of the motor bracket. According to this structure, the first end of the spring member can be easily engaged with the motor bracket.

In the image generating apparatus according to the aforementioned second embodiment, the first end of the spring member is preferably bent at two points of a first bent portion and a second bent portion closer to a forward end than the first bent portion to be formed in a U-shape, and an interval between the first bent portion and the second bent portion is preferably formed to be substantially equal to an interval between the notch of the motor bracket and the edge portion. According to this structure, a portion from the first bent portion of the spring member to the second bent portion can be brought in close contact with a portion from the notch of the motor bracket to the edge portion, and the portion from the second bent portion to the forward end can be mounted so as to be hooked onto the edge portion. Thus, the first end of the spring member can be inhibited from wobbling with respect to the motor bracket.

In the image generating apparatus according to the aforementioned second embodiment, the first end of the spring member is preferably formed in a U-shape, the U-shaped first end of the spring member is preferably engaged so as to be hooked onto the spring engaging portion, the motor bracket preferably includes a wall surface portion extending in a direction intersecting with a direction in which the first end of the spring member protrudes from the take-up member, and the spring engaging portion is preferably provided in the wall surface portion. According to this structure, the U-shaped first end of the spring member can be easily engaged so as to be hooked onto the wall surface portion dissimilarly to a case where the spring engaging portion is provided at a portion in the motor bracket, extending in a direction parallel to a direction in which the first end of the spring member protrudes from the take-up member.

In the image generating apparatus according to the aforementioned second embodiment, the guide portion is preferably so formed that a notch width is gradually increased from the bottom portion of the notch toward the open end of the notch. According to this structure, the first end of the spring member inserted into the open end with the large notch width is guided by the guide portion to reach the bottom portion with the small notch width. Thus, the spring member can be easily engaged with the spring engaging portion.

In the image generating apparatus according to the aforementioned second embodiment, the take-up member preferably further includes a gear member rotated by driving force of the motor, a rotating member for taking up the ink sheet by rotation following rotation of the gear member and an intervening member arranged between the gear member and the rotating member in order to interrupt transmission of the rotation of the gear member to the rotating member in a case where a prescribed load torque or more is applied to the rotating member, the gear member, the rotating member and the intervening member preferably constitute a torque limiter, and the spring mount portion is preferably so formed as to integrally rotate with the gear member. According to this structure, the spring mount portion and the spring member can inhibit the take-up member from rotating an opposite direction from the take-up direction, and the torque limiter constituted by the gear member, the rotating member and the intervening member can inhibit an load from being applied to the ink sheet in a case where the take-up member rotates in the take-up direction

DESCRIPTION OF THE PREFERRED EMBODIMENTS

An embodiment of the present invention will be hereinafter described with reference to the drawings.

A structure of a thermal transfer printer according to the embodiment of the present invention will be now described with reference to FIGS. 1 to 10. According to this embodiment, the present invention is applied to the thermal transfer printer, which is an exemplary image generating apparatus.

Figure 1:
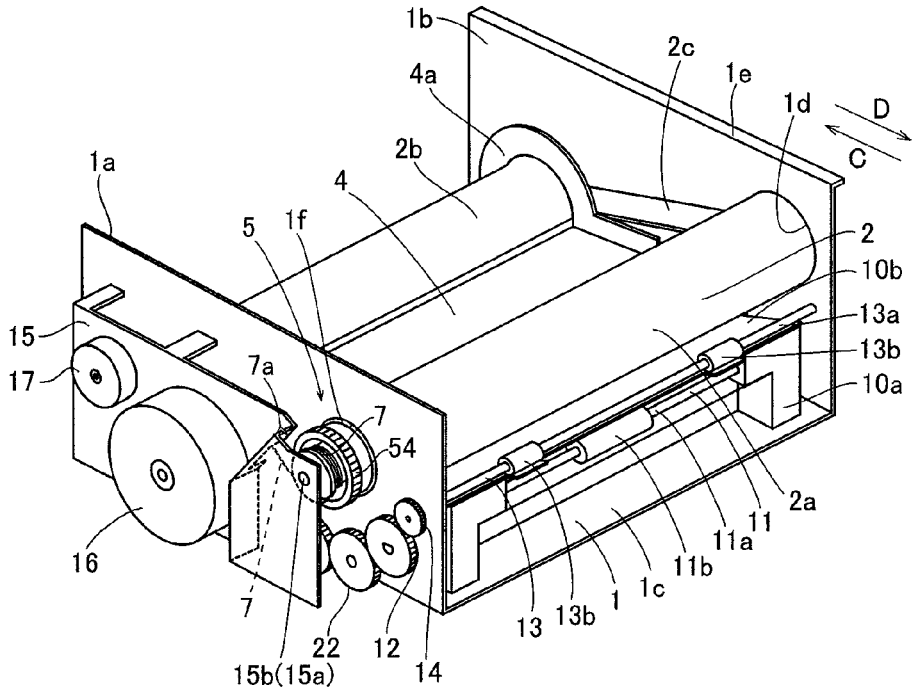
FIG. 1 is a perspective view showing an overall structure of a thermal transfer printer according to an embodiment of the present invention.
Figure 2:
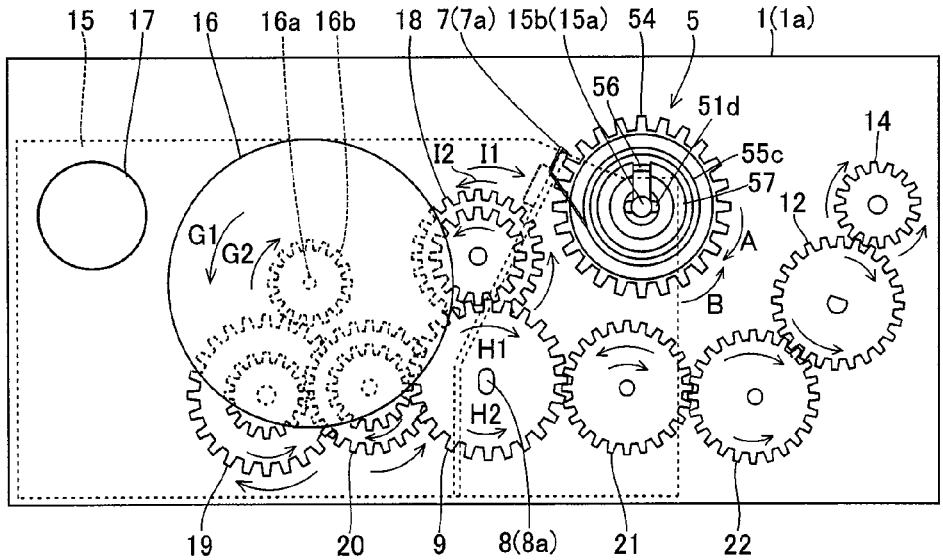
FIG. 2 is a front view showing motors and each gear of the thermal transfer printer according to the embodiment of the present invention shown in FIG. 1.
Figure 3:
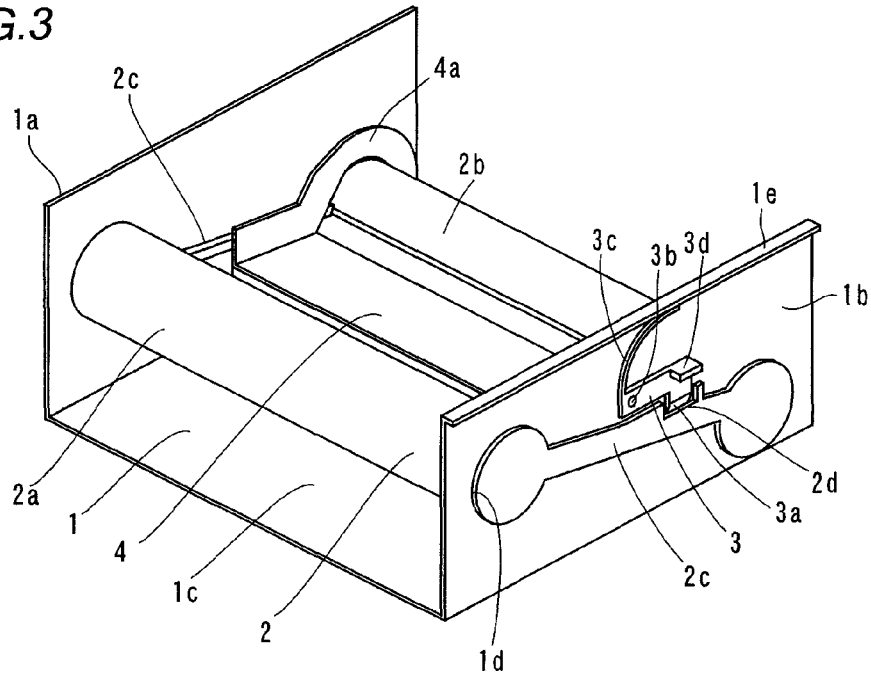
FIG. 3 is a perspective view of the thermal transfer printer according to the embodiment of the present invention shown in FIG. 1 as viewed from a second side surface of a chassis.

The thermal transfer printer according to the embodiment comprises a chassis 1 made of metal, a stopper member 3 (see FIG. 3) for fixing an ink sheet cartridge 2, a print head 4 for printing, a take-up reel 5 (see FIGS. 1 and 2) and a feed reel 6 (see FIG. 10) engaged with the ink sheet cartridge 2, a spring member 7 regulating a direction of rotation of the take-up reel 5, a feed roller 8 (see FIG. 2), a feed roller gear 9 (see FIG. 2), a lower paper guide 10*a* made of resin, an upper paper guide 10*b* made of resin, a paper feed roller 11, a paper feed roller gear 12, a paper discharge roller 13, a paper discharge roller gear 14, a motor bracket 15, a paper feed motor 16 for carrying a paper, a motor 17 serving as a drive source for rotation of the print head 4, a swingable swing gear 18 (see FIG. 2), a plurality of intermediate gears 19 to 22 (see FIG. 2), as shown in FIGS. 1 to 3. The thermal transfer printer according to the embodiment is mounted with the ink sheet cartridge 2 as shown in FIG. 1. The take-up reel 5 and the paper feed motor 16 are examples of the "take-up member" and the "motor" in the present invention respectively.

Figure 10:
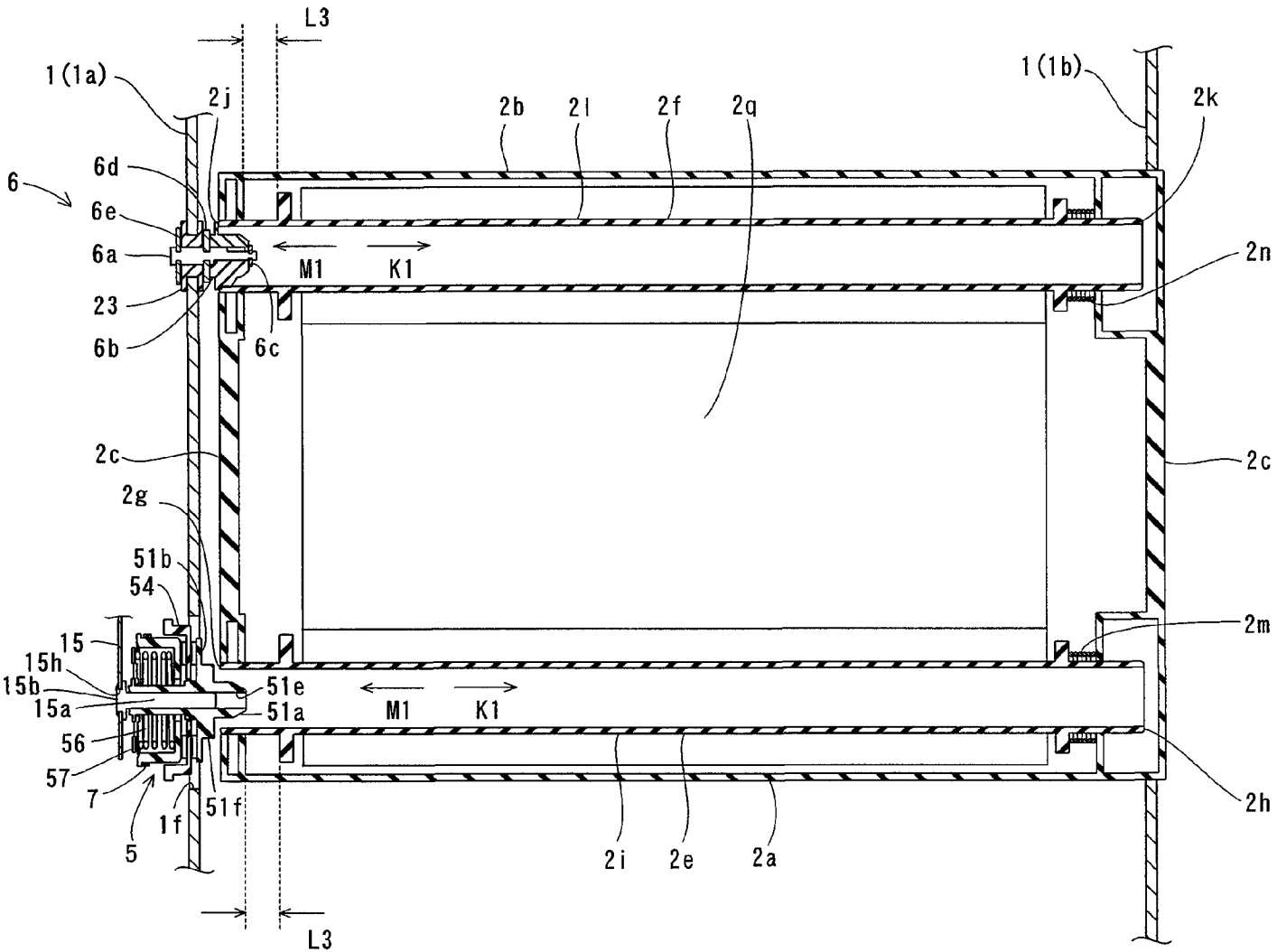
FIG. 10 is a sectional view showing a state in which the thermal transfer printer according to the embodiment of the present invention shown in FIG. 1 is mounted with the ink sheet cartridge.

The chassis 1 has a first side surface 1*a*, a second side surface 1*b* and a bottom surface 1*c*, as shown in FIGS. 1 and 3. The aforementioned motor bracket 15 is mounted on the first side surface 1*a* of the chassis 1 as shown in FIG. 1. A receiving hole 1*d* for receiving the ink sheet cartridge 2 and a bent portion 1*e* are provided on the second side surface 1*b* of the chassis 1. An opening if receiving the take-up reel 5 is provided on the first side surface 1*a* of the chassis 1, as shown in FIGS. 1 and 10.

The stopper member 3 has a stop portion 3*a*, a support portion 3*b*, a plate spring portion 3*c* and a grip 3*d* as shown in FIG. 3. This stop portion 3*a* has a function of fixing the ink sheet cartridge 2 inserted into the thermal transfer printer. The support portion 3*b* is mounted on the second side surface 1*b* of the chassis 1, while rotatably supporting the stopper member 3. The plate spring portion 3*c* comes into contact with the bent portion 1*e* on the second side surface 1*b* of the chassis 1, while urging the stopper member 3 downwardly. The grip 3*d* is lifted up against urging force of the plate spring portion 3*c*, whereby the stop portion 3*a* is so formed as to be dismounted from an after-mentioned recess portion 2*d* of the ink sheet cartridge 2.

As shown in FIGS. 1 and 3, the print head 4 for printing has arm portions 4*a*. The print head 4 is mounted inside the first side surface 1*a* and the second side surface 1*b* of the chassis 1 to be rotatable about a support shaft (not shown) engaged with ends (not shown) of the arm portions 4*a*.

Figure 5:
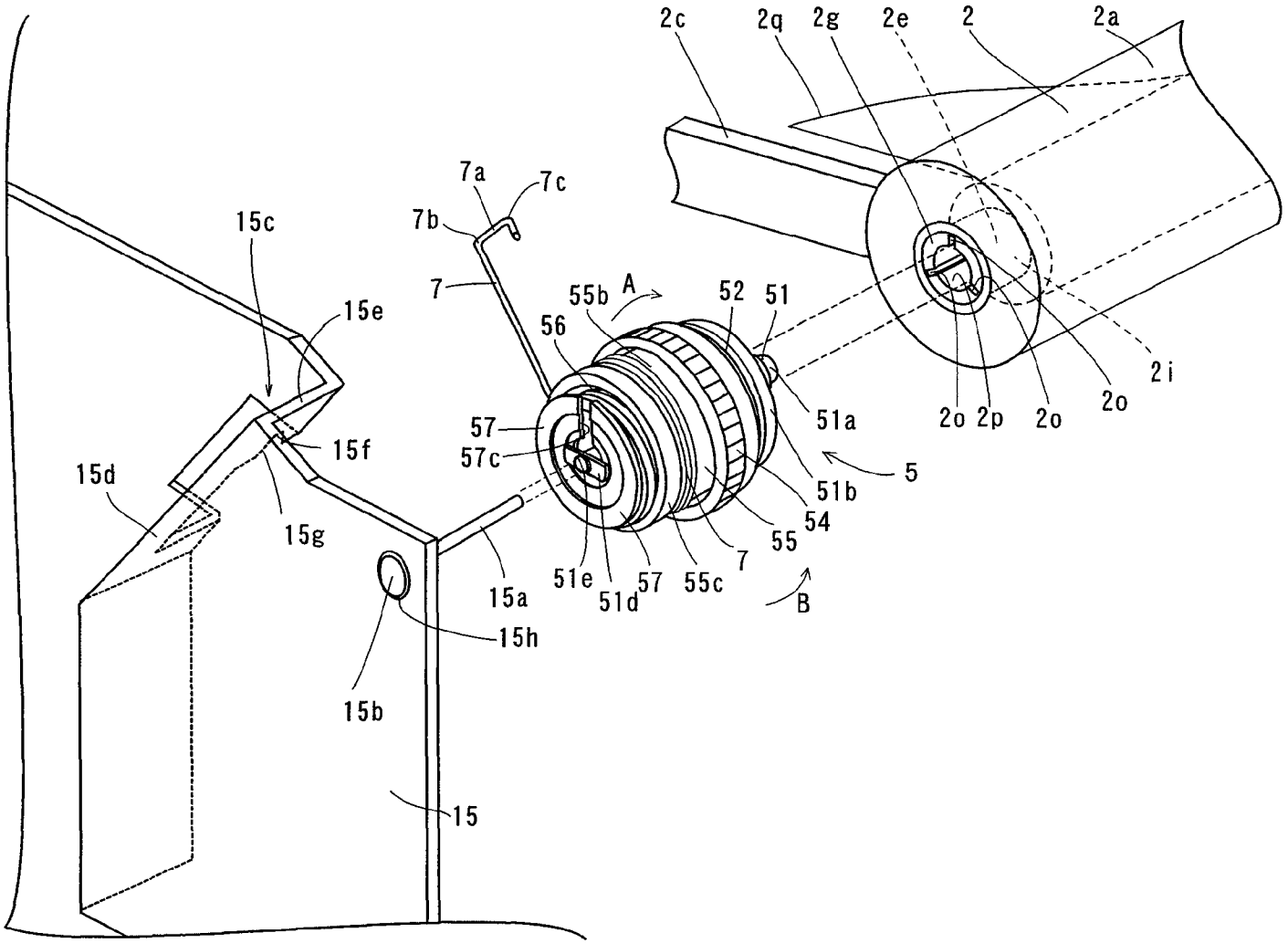
FIG. 5 is an exploded perspective view of the take-up reel, the motor bracket and an ink sheet cartridge of the thermal transfer printer according to the embodiment of the present invention shown in FIG. 1.

The take-up reel 5 is provided for receiving driving force of the paper feed motor 16 to rotate and taking up an ink sheet 2*q* (see FIG. 5). According to the embodiment, the take-up reel 5 is rotatably mounted on a rotary shaft 15*a* fixed to a shaft fixing portion 15*h* of the motor bracket 15 by caulking, as shown in FIGS. 5 to 7 and FIG. 9. The take-up reel 5 includes a rotating member 51 made of resin, ring-shaped felts 52 and 53, a gear member 54, a clutch plate 55, a helical compression spring 56 and a clutch base 57 as shown in FIGS. 8 and 9. The rotating member 51 has a take-up bobbin engaging portion 51*a*, a plate portion 51*b* integrally formed with the take-up bobbin engaging portion 51*a*, a shaft portion 51*c* receiving the gear member 54 and the like, an engaging plate portion 51*d* engaged with the clutch base 57, a hole 51*e* for receiving the rotary shaft 15*a* of the motor bracket 15. The take-up bobbin engaging portion 51*a* of the rotating member 51 is formed with three engaging pawls 51*f* engaged with after-mentioned grooves 20 of the take-up bobbin 2*e* (see FIG. 5) respectively. The felt 52 is an example of the "intervening member" in the present invention.

According to the embodiment, the felts 52 and 53 have holes 52*a* and 53*a* for receiving the shaft portion 51*c* of the rotating member 51 respectively, as shown in FIGS. 8 and 9. The gear member 54 has a hole 54*a* for receiving the shaft portion 51*c* of the rotating member 51. The gear member 54 has a function of rotating the take-up reel 5 by transmission of driving force of the paper feed motor 16. The clutch plate 55 has a hole 55*a* for receiving the shaft portion 51*c* of the rotating member 51, a spring mount portion 55*b* wound with the spring member 7 and a rib 55*c* for suppressing falling of the spring member 7. This rib 55*c* is integrally provided on an end of the spring mount portion 55*b* closer to the motor bracket 15 (shaft fixing portion 15*h* (see FIG. 9)). The clutch base 57 has a hole 57*a* for receiving the shaft portion 51*c* of the rotating member 51, a fit-in portion 57*b* fit with the engaging plate portion 51*d* of the rotating member 51 and a notch 57*c* for fitting the engaging plate portion 51*d* of the rotating member 51 into the fit-in portion 57*b* of the clutch base 57. The engaging plate portion 51*d* of the rotating member 51 is rotated by 90 degrees after being inserted into the hole 57*a* through the notch 57*c* of the clutch base 57, whereby the engaging plate portion 51*d* of the rotating member 51 is fitted into the fit-in portion 57*b* of the clutch base 57 (see FIG. 5).

The felts 52 and 53 are bonded to a back surface of the plate portion 51*b* of the rotating member 51 and an upper surface of the clutch plate 55 respectively.

The helical compression spring 56 is arranged between the clutch plate 55 and the clutch base 57 as shown in FIG. 9. The helical compression spring 56 has a function of urging the clutch plate 55 bonded with the felt 53 and the gear member 54 to the plate portion 51*b* of the rotating member 51 bonded with the felt 52 (along arrow K1 in FIG. 9).

Thus, the take-up reel 5 is assembled by the rotating member 51, the felts 52 and 53, the gear member 54, the clutch plate 55, the helical compression spring 56 and the clutch base 57. The gear member 54 is held between the felt 52 bonded to the rotating member 51 and the felt 53 bonded to the clutch plate 55, while being pressed with urging force of the helical compression spring 56. Thus, the gear member 54, the clutch plate 55 and the rotating member 51 are so formed as to integrally rotate each other by friction between the gear member 54 and the felts 52 and 53. In a case where prescribed load torque or more is applied to the take-up bobbin engaging portion 51*a* of the rotating member 51, frictional force is adjusted such that the felt 52 bonded to the plate portion 51*b* of the rotating member 51 is slipped with respect to the gear member 54. Thus, even if the gear member 54 rotates, the plate portion 51*b* of the rotating member 51 is formed so as not to rotate. In other words, the rotating member 51, the felt 52 and the gear member 54 constitute a torque limiter.

The feed reel 6 includes a rotary shaft 6*a* made of metal, a feed bobbin engaging portion 6*b* made of resin mounted on a first end of the rotary shaft 6*a*, a stop retaining ring 6*c* made of metal, position regulating retaining rings 6*d* and 6*e*, as shown in FIG. 10. The rotary shaft 6*a* is rotatably mounted on the first side surface 1*a* of the chassis 1 by a bearing member 22, and the position regulating retaining rings 6*d* and 6*e* regulate the position of a shaft direction.

Figure 4:
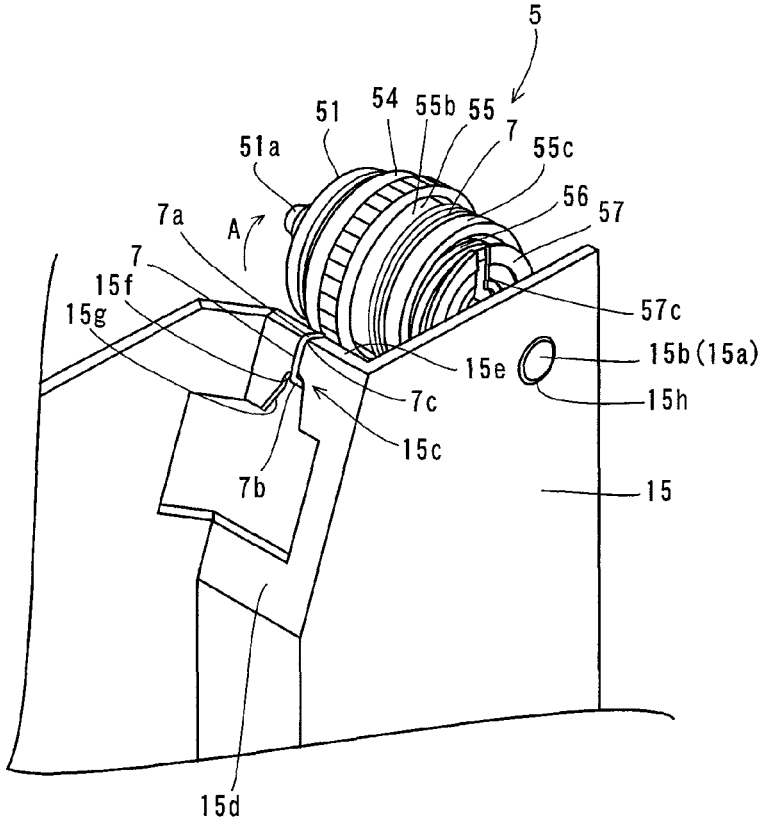
FIG. 4 is a perspective view of a take-up reel and a motor bracket of the thermal transfer printer according to the embodiment of the present invention shown in FIG. 1.
Figure 6:
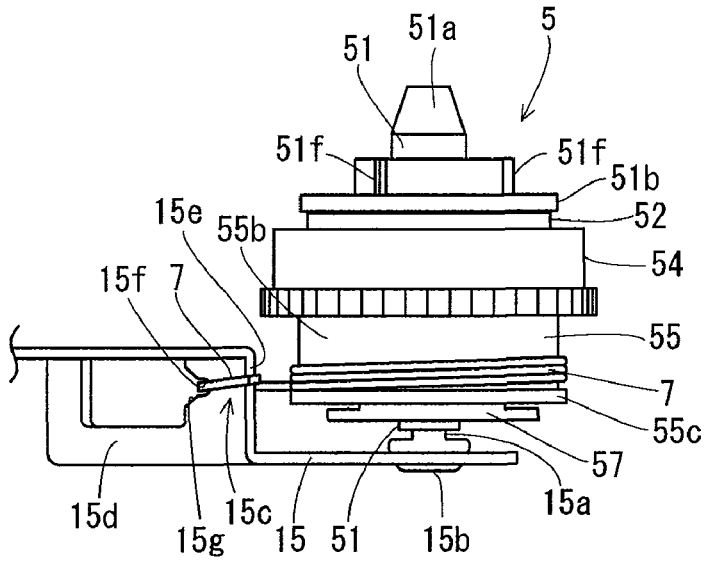
FIG. 6 is a plan view of the take-up reel and the motor bracket of the thermal transfer printer according to the embodiment of the present invention shown in FIG. 1.
Figure 7:
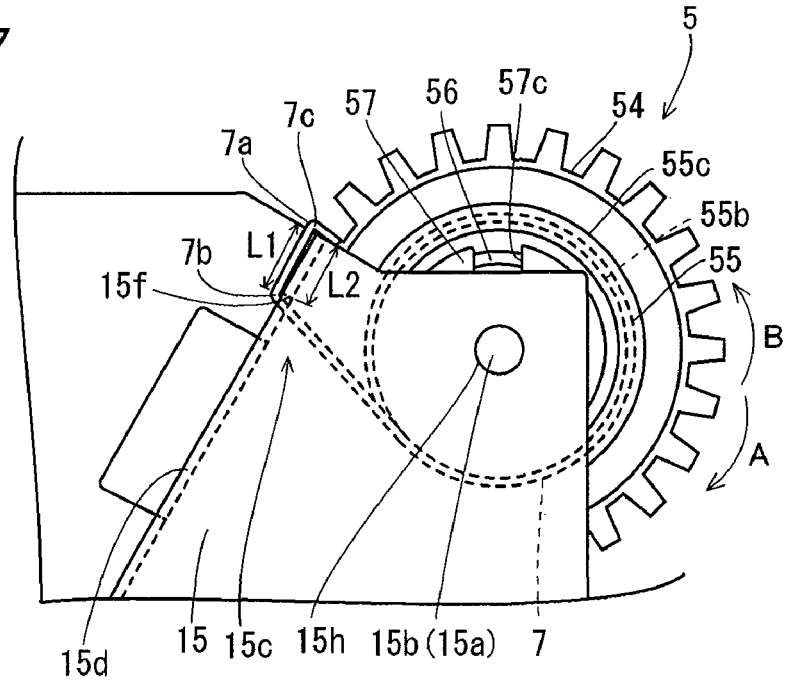
FIG. 7 is a front view of the take-up reel and the motor bracket of the thermal transfer printer according to the embodiment of the present invention.
Figure 8:
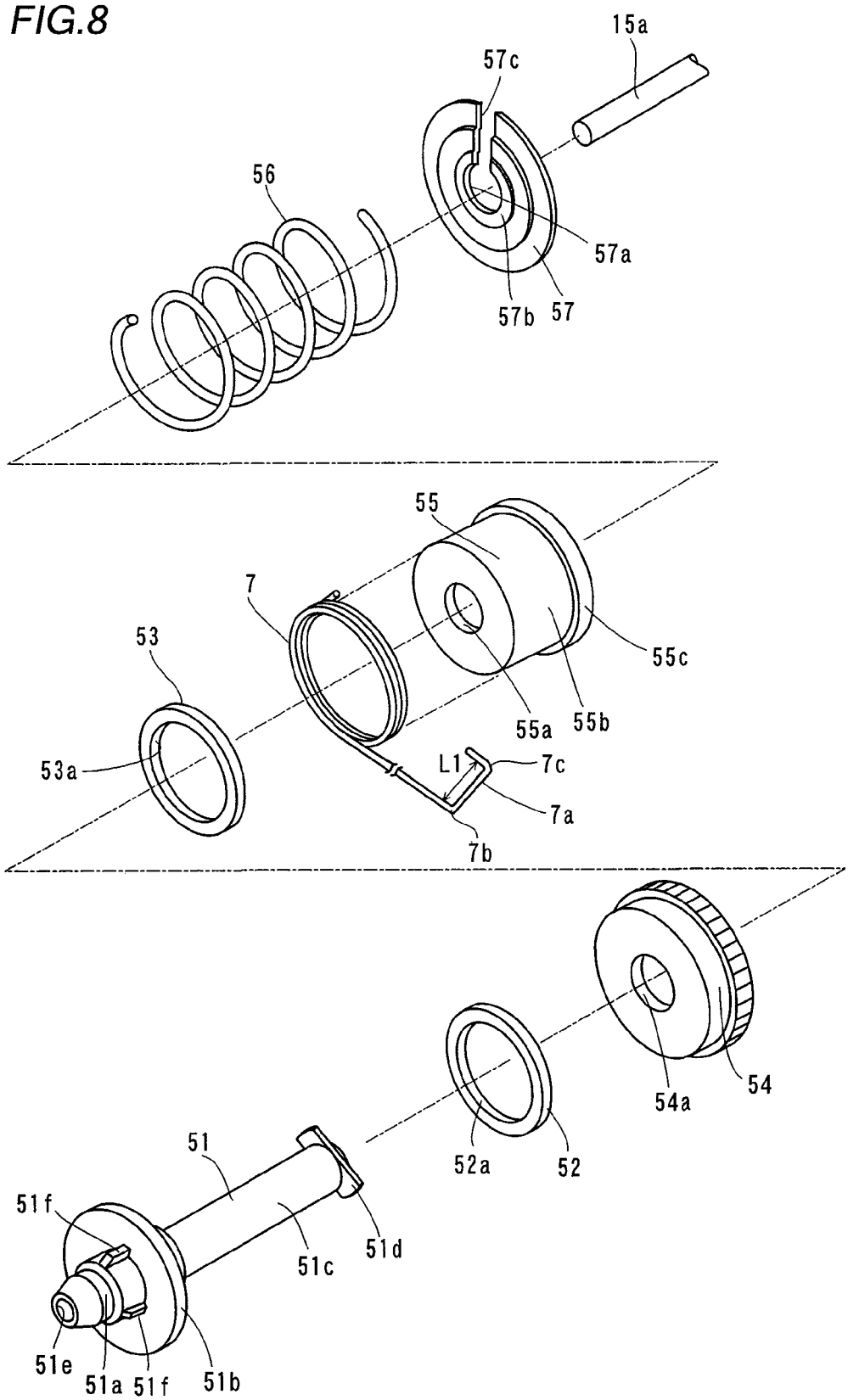
FIG. 8 is an exploded perspective view of the take-up reel of the thermal transfer printer according to the embodiment of the present invention.
Figure 9:
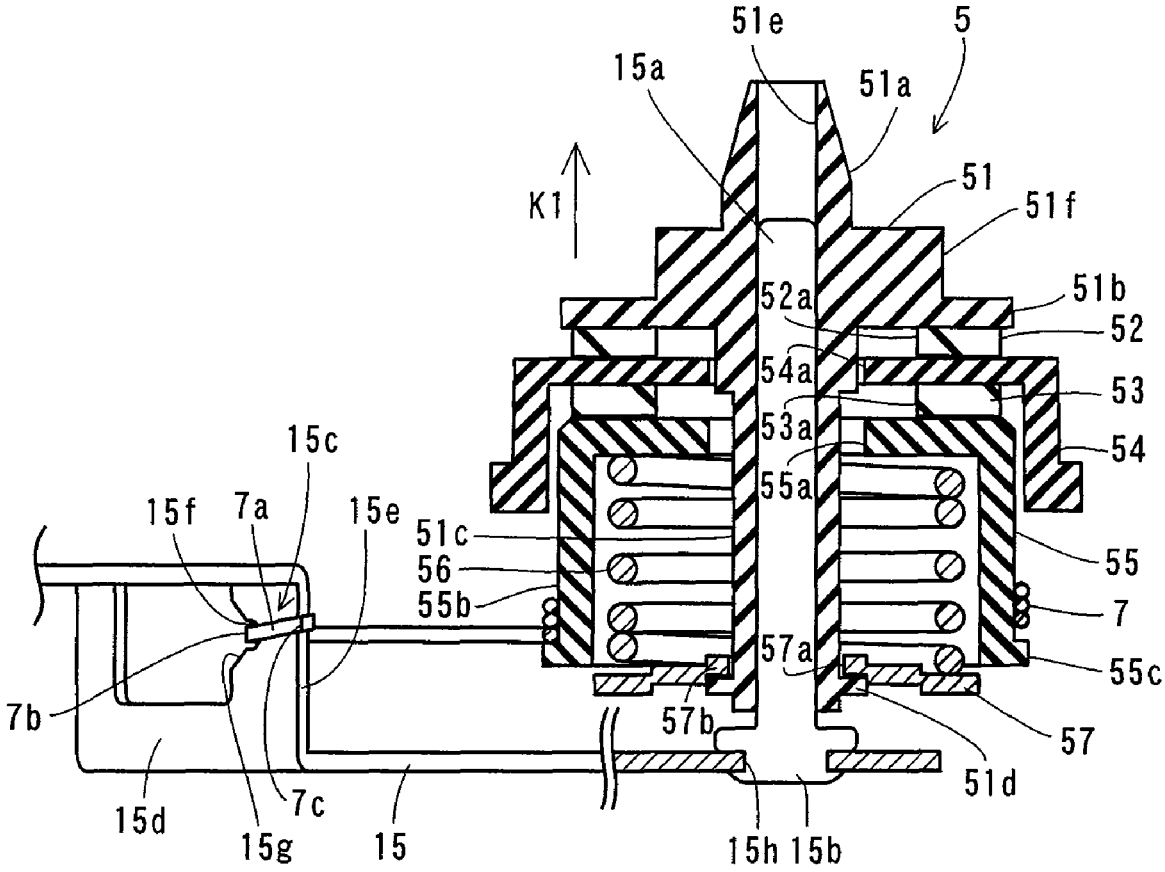
FIG. 9 is a sectional view of the take-up reel and the motor bracket of the thermal transfer printer according to the embodiment of the present invention.

According to the embodiment, the spring member 7 is so mounted on the spring mount portion 55*b* of the clutch plate 55 of the take-up reel 5 as to be in close contact with an outer circumference of the spring mount portion 55*b*, as shown in FIGS. 4 to 9. As shown in FIGS. 4, 6 and 7, the first end 7*a* of the spring member 7 has a U-shape, and is fixed by engagement with the spring engaging portion 15*c* of the motor bracket 15 described later. The spring member 7 is bent at two points of a bent portion 7*b* and a bent portion 7*c* closer to a forward end than the bent portion 7*b* to be formed in a U-shape. The bent portion 7*b* and the bent portion 7*c* are examples of the "first bent portion" and the "second bent portion" in the present invention respectively.

The spring member 7 has a spring take-up direction to reduce a spring diameter when the take-up reel 5 rotates in an opposite direction (B direction) to a direction of rotation (A direction) in taking up the ink sheet 2*q*. That is to say, this spring member 7 has a function of regulating the take-up reel 5 to rotate only in the direction of rotation (A direction) in taking up the ink sheet 2*q*. More specifically, since the first end 7*a* of the spring member 7 is engaged with the spring engaging portion 15*c* of the motor bracket 15, when the take-up reel 5 tries to rotate in the opposite direction (direction B) to the direction of rotation in taking up the ink sheet 2*q*, the spring diameter of the spring member 7 is reduced due to the frictional force between the spring member 7 and the surface of the spring mount portion 55*b*. Thus, the spring mount portion 55*b* is fastened by the spring member 7, whereby rotation in the direction B of the clutch plate 55 is suppressed. As described above, the rotating member 51, the gear member 54 and the clutch plate 55 are so formed as to integrally rotate each other by the felts 52 and 53 and the helical compression spring 56, whereby the rotation of the clutch plate 55 is suppressed, thereby suppressing the rotation of the overall take-up reel 5.

According to the embodiment, the rib 55*c* is circumferentially provided on the end closer to the motor bracket 15 (shaft fixing portion 15*h* (see FIG. 9)) of the spring mount portion 55*b* of the clutch plate 55. As described above, the first end 7*a* of the spring member 7 is fixed to the spring engaging portion 15*c* of the motor bracket 15. Thus, when the take-up reel 5 mounted with the spring member 7 tries to move in a falling direction from the rotary shaft 15*a*, the spring engaging portion 15*c* can inhibit the spring member 7 from moving in the falling direction of the take-up reel 5, and the circumferential rib 55*c* can inhibit the spring member 7 from falling from the spring mount portion 55*b* of the take-up reel 5, whereby the take-up reel 5 mounted with the spring member 7 can be inhibited from falling from the rotary shaft 15*a*. In addition, the circumferential rib 55*c* is integrally provided with the spring mount portion 55*b*, whereby no stop member such as a retaining ring may be separately provided, and the take-up reel 5 can be inhibited from falling from the thermal transfer printer.

The feed roller 8 is so formed as to rotate with the rotation of the feed roller gear 9, and has a function of carrying a paper in a paper feed direction (along arrow C in FIG. 1) and a paper discharge direction (along arrow D direction) by holding the paper between the press roller (not shown) and the feed roller 8. The feed roller 8 includes a gear insert portion 8*a* inserted into the feed roller gear 9, as shown in FIG. 2.

The lower paper guide 10*a* is set in the vicinity of the paper feed roller 11, as shown in FIG. 1. The lower paper guide 10*a* has a function of passing a paper fed by the paper feed roller 11 through an upper surface of the lower paper guide 10*a* in paper feeding, to guide the paper to a paper feed path toward the print head 4.

The upper paper guide 10*b* is supported by the lower paper guide 10*a*. The upper paper guide 10*b* is supported in an inclined state at a prescribed angle with respect to the bottom surface 1*c* of the chassis 1. Thus, the upper paper guide 10*b* has a function of passing a paper fed by the feed roller 8 through an upper surface of the upper paper guide 10*b* in an inclined state at a prescribed angle in paper discharging, to guide the paper to a paper discharge path toward the paper discharge roller 13.

The paper feed roller 11 is provided for feeding a paper to a printing position at which the printing is performed by the print head 4. The paper feed roller 11 has a shaft portion 11*a* made of metal and a roller portion 11*b* made of rubber fitted into the shaft portion 11*a*, as shown in FIG. 1. The paper feed roller gear 12 is mounted on an end of the shaft portion 11*a* of the paper feed roller 11 closer to the first side surface 1*a* of the chassis 1

The paper discharge roller 13 is provided for discharging a paper printed by the print head 4. The paper discharge roller 13 has a shaft portion 13*a* made of metal and a roller portion 13*b* made of rubber fitted into the shaft portion 13*a*, as shown in FIG. 1. The paper discharge roller gear 14 is mounted on an end of the shaft portion 13*a* of the paper discharge roller 13 closer to the first side surface 1*a* of the chassis 1.

According to the embodiment, the shaft fixing portion 15*h* of the motor bracket 15 is directly fixed with a first end 15*b* of the rotary shaft 15*a* by caulking so as to extend inside the chassis 1 through the opening 1*f* of the chassis 1, as shown in FIGS. 9 and 10. As shown in FIGS. 4 to 7, the motor bracket 15 includes the spring engaging portion 15*c* having a concave notch, and the first end 7*a* of the spring member 7 is engaged with the spring engaging portion 15*c*. The spring engaging portion 15*c* is provided on a wall surface portion 15*d* extending in a direction intersecting with a direction in which the first end 7*a* of the spring member 7 protrudes from the take-up reel 5. The U-shaped first end 7*a* of the spring member 7 is engaged so as to be hooked onto the spring engaging portion 15*c* for fixing. More specifically, the forward end of the first end 7*a* is so mounted as to be hooked onto an upper edge 15*e* of the wall surface portion 15*d* of the motor bracket 15, after the spring member 7 is inserted into a notch of the spring engaging portion 15*c*. As shown in FIG. 7, an interval L1 between the bent portion 7*b* and the bent portion 7*c* of the U-shaped first end 7*a* of the spring member 7 has the substantially same size as that of an interval L2 between a bottom portion 15*f* of the notch of the spring engaging portion 15*c* and the upper edge 15*e* of the motor bracket 15. Thus, the spring member 7 is inhibited from wobbling with respect to the spring engaging portion 15*c*. As shown in FIGS. 4 and 6, a guide portion 15*g* having a notch width larger than a notch width of the bottom portion 15*f* of the notch is provided on an open end of the notch of the spring engaging portion 15*c*. The guide portion 15*g* is so formed that the notch width is gradually increased from the bottom portion 15*f* of the notch of the spring engaging portion 15*c* to the open end of the notch. The guide portion 15*g* plays a role of a guide when the spring member 7 is engaged with the spring engaging portion 15*c*, whereby the spring member 7 can be easily engaged with the spring engaging portion 15*c*. The edge 15*e* is an example of the "edge portion" in the present invention.

The motor gear 16*b* is mounted on a shaft portion 16*a* of the paper feed motor 16 mounted to the motor bracket 15, as shown in FIG. 2. The paper feed motor 16 has a function as a driving source for driving the gear member 54 of the take-up reel 5, the feed roller gear 9, the paper feed roller gear 12, the paper discharge roller gear 14 and the intermediate gears 19 to 22. The motor 17 has a function as a driving source rotating a press member (not shown) for pressing the print head 4 against a platen roller (not shown) through a gear (not shown).

The ink sheet cartridge 2 has an ink sheet take-up portion 2*a*, an ink sheet feed portion 2*b* and coupling portions 2*c*, as shown in FIGS. 1 and 3. The recess portion 2*d* engaged with the stop portion 3*a* of the stopper member 3 is provided on the coupling portion 2*c* of the ink sheet cartridge 2 closer to the second side surface 1*b* of the chassis 1, as shown in FIG. 3. The take-up bobbin 2*e* is rotatably arranged inside the ink sheet take-up portion 2*a* of the ink sheet cartridge 2 while capable of moving along arrow K1 in FIG. 10 by a discharge stroke (L3 in FIG. 10), as shown in FIG. 10. The feed bobbin 2*f* is rotatably arranged inside the ink sheet feed portion 2*b* of the ink sheet cartridge 2 while capable of moving along arrow K1 in FIG. 10 by the discharge stroke (L3 in FIG. 10). The take-up bobbin 2*e* has a first end 2*g*, a second end 2*h* and a shaft portion 2*i*, as shown in FIG. 10. The feed bobbin 2*f* has a first end 2*j*, a second end 2*k* and a shaft portion 2*l*. The first ends 2*g* and 2*j* of the take-up bobbin 2*e* and the feed bobbin 2*f* are so arranged as to protrude from the ink sheet cartridge 2 in a direction of the first side surface 1*a* of the chassis 1 (along arrow M1 in FIG. 10) by the discharge stroke (L3 in FIG. 10).

As shown in FIG. 10, helical compression springs 2*m* and 2*n* are mounted in the vicinities of the second ends 2*h* and 2*k* of the take-up bobbin 2*e* and the feed bobbin 2*f* respectively. The helical compression springs 2*m* and 2*n* have functions of urging the take-up bobbin 2*e* and the feed bobbin 2*f* in a direction of the take-up reel 5 and the feed reel 6 (along arrow M1 in FIG. 10), respectively. In addition, the helical compression springs 2*m* and 2*n* have functions of generating moving force for moving the ink sheet cartridge 2 in a discharge direction (along arrow K1 in FIG. 10) by the discharge stroke (L3 in FIG. 10) in discharging of the ink sheet cartridge 2 (at the time of releasing the engagement of the stop portion 3*a* of the stopper member 3 and the recess portion 2*d* of the ink sheet cartridge 2). A recess portion 2*p* having three grooves 20 is provided on the first end 2*g* of the take-up bobbin 2*e* as shown in FIG. 5. A recess portion (not shown) having three grooves is provided on the first end 2*j* of the feed bobbin 2*f* similarly to the first end 2*g* of the take-up bobbin 2*e*. The ink sheet 2*q* is wound around the shaft portion 2*i* of the take-up bobbin 2*e* and the shaft portion 2*l* of the feed bobbin 2*f*, as shown in FIGS. 5 and 10.

FIGS. 11 to 14 illustrate a method of mounting the take-up real and the spring member of the thermal transfer printer according to the embodiment of the present invention. The method of mounting the take-up reel and the spring member of the thermal transfer printer according to the embodiment of the present invention will be now described with reference to FIGS. 6 and 7 and FIGS. 11 to 14.

Figure 11:
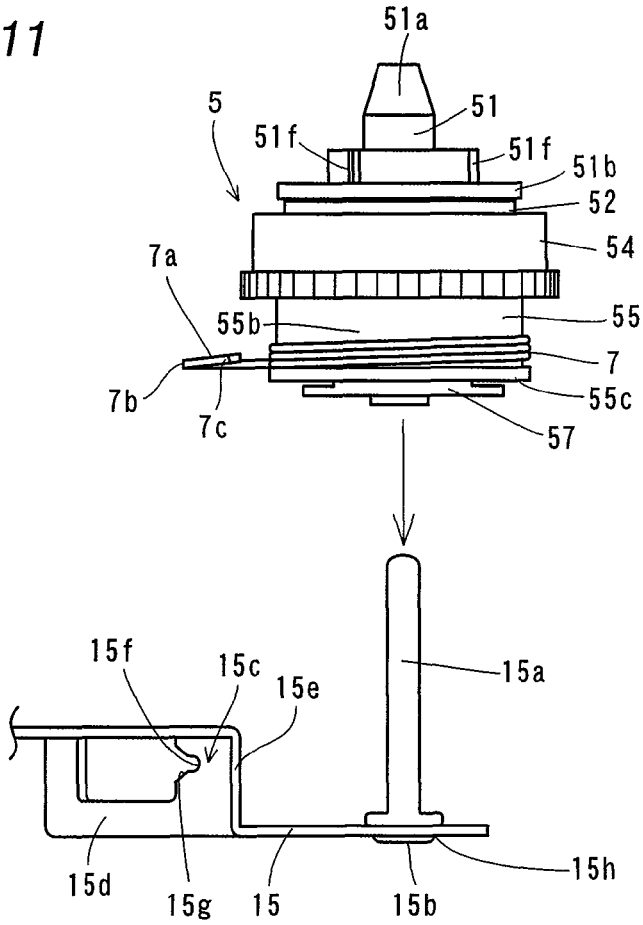
FIGS. 11 to 14 are views illustrating a method of mounting the take-up reel of the thermal transfer printer according to the embodiment of the present invention to the motor bracket.
Figure 12:
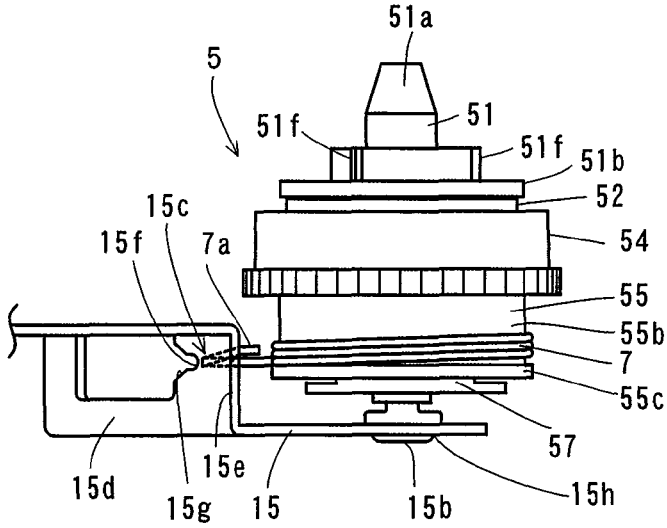
Figure 13:
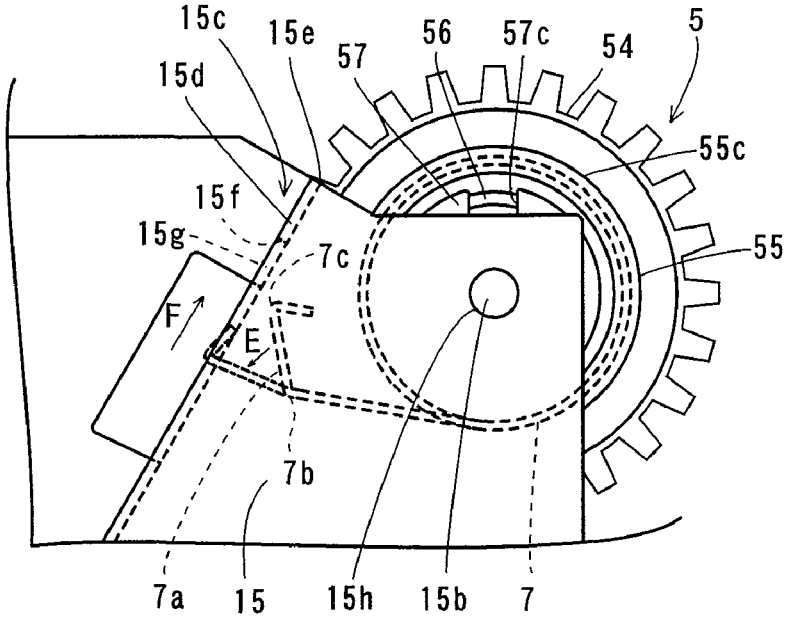
Figure 14:
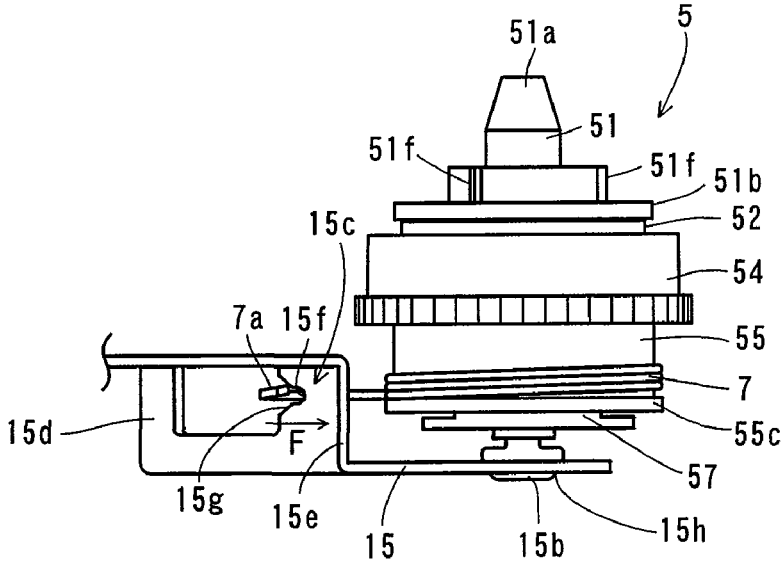

First, the take-up reel 5 mounted with the spring member 7 receives the rotary shaft 15*a* fixed to the motor bracket 15 as shown in FIGS. 12 and 11. The U-shaped first end 7*a* of the spring member 7 is deflected in an E direction as shown in FIG. 13. The deflected first end 7*a* is inserted into the notch of the spring engaging portion 15*c* of the wall surface portion 15*d*. The U-shaped first end 7*a* of the spring member 7 is moved upwardly (in an F direction) as shown in FIGS. 13 and 14. The guide portion 15*g* is provided in the spring engaging portion 15*c*, whereby the bent portion 7*b* of the spring member 7 can be easily guided to be located at the bottom portion 15*f* of the notch. In a state where the bent portion 7*b* is located at the bottom portion 15*f* of the notch, a portion from the bent portion 7*c* of the spring member 7 to the forward end is hooked onto the upper edge 15*e* of the wall surface portion 15*d*. Thus, the first end 7*a* of the spring member 7 is engaged with the spring engaging portion 15*c*, as shown in FIGS. 6 and 7.

A take-up operation of the ink sheet 2*q* of the take-up reel 5 in the thermal transfer printer according to the embodiment of the present invention will be now described with reference to FIGS. 2, 5 and 10.

As shown in FIG. 2, the motor gear 16*b* mounted on the shaft portion 16*a* of the paper feed motor 16 rotates along arrow G1 in FIG. 2 following the paper feed motor 16, for rotating the feed roller gear 9 along arrow H1 in FIG. 2 through the intermediate gears 19 and 20. Thus, the swingable swing gear 18 swings in a direction to be meshed with the gear member 54 of the take-up reel 5 (along arrow I1 in FIG. 2), to mesh with the gear member 54 of the take-up reel 5. Then, the gear member 54 of the take-up reel 5 rotates along arrow A (take-up direction) in FIG. 2.

At this time, as described above, the gear member 54, the clutch plate 55 and the rotating member 51 are so formed as to integrally rotate each other, whereby the take-up bobbin engaging portion 51*a* of the rotating member 51 also rotates along arrow A. Consequently, the take-up bobbin 2*e* of the ink sheet cartridge 2 engaged with the take-up bobbin engaging portion 51*a* of the rotating member 51 rotates along arrow A in FIG. 5, whereby the take-up bobbin 2*e* takes up the ink sheet 2*q*.

The take-up bobbin 2*e* takes up the ink sheet 2*q*, whereby the feed bobbin 2*f* (see FIG. 10) wound with the ink sheet 2*q* also rotates, thereby also rotating the feed reel 6 (see FIG. 10) engaged with the feed bobbin 2*f*. In this case, when a prescribed torque or more is applied to the take-up bobbin engaging portion 51*a* of the rotating member 51, the felt 52 mounted on the plate portion 51*b* of the rotating member 51 is slipped with respect to the gear member 54, whereby the plate portion 51*b* (rotating member 51) does not rotate even if the gear member 54 is rotating.

The motor gear 16*b* mounted on the shaft portion 16*a* of the paper feed motor 16 rotates along arrow G2 in FIG. 2 following the paper feed motor 16, for rotating the feed roller gear 9 along arrow H2 in FIG. 2 through the intermediate gears 19 and 20. Thus, the swingable swing gear 18 swings in a direction away from the gear member 54 of the take-up reel 5 (along arrow 12 in FIG. 2).

When the swing gear 18 moves away from the gear member 54 of the take-up reel 5, the take-up reel 5 tries to rotate in the opposite direction (direction B) to a direction to take up the ink sheet 2*q* in response to the reaction. At this time, the spring diameter of the spring member 7 mounted on the spring mount portion 55*b* of the clutch plate 55 of the take-up reel 5 is reduced, an outer circumferential surface of the spring mount portion 55*b* of the clutch plate 55 is fastened by an inner surface of the spring member 7. Therefore, rotation of the clutch plate 55 is suppressed, while rotation of the take-up reel 5 is suppressed. Thus, the take-up bobbin 2*e* engaged with the take-up reel 5 is inhibited from rotating in the opposite direction (direction B) to the direction to take up the ink sheet 2*q*, whereby the looseness of the ink sheet 2*q* can be suppressed.

According to the embodiment, as hereinabove described, the spring member 7 for regulating to rotate the take-up reel 5 only in the take-up direction is mounted on the spring mount portion 55*b* of the take-up reel 5, the spring engaging portion 15*c* engaged with the first end 7*a* of the spring member 7 is provided, and the circumferential rib 55*c* for suppressing the falling of the spring member 7 is integrally provided on the spring mount portion 55*b* of the take-up reel 5. Therefore, when the take-up reel 5 mounted with the spring member 7 tries to move in the falling direction from the rotary shaft 15*a*, the engagement of the first end 7*a* of the spring member 7 with the spring engaging portion 15*c* can inhibit the spring member 7 from moving in the falling direction of the take-up reel 5 and the circumferential rib 55*c* can inhibit the spring member 7 from falling from the spring mount portion 55*b* of the take-up reel 5. Thus, the take-up reel 5 mounted with the spring member 7 can be inhibited from falling from the rotary shaft 15*a*. In addition, the circumferential rib 55*c* is integrally provided with the spring mount portion 55*b*, whereby no stop member such as a retaining ring may be separately provided, and the take-up reel 5 can be inhibited from falling from the thermal transfer printer.

According to the embodiment, as hereinabove described, the first end 7*a* of the spring member 7 is formed in a U-shape, and the U-shaped first end 7*a* of the spring member 7 is engaged so as to be hooked onto the spring engaging portion 15*c*, whereby the spring engaging portion 15*c* can easily inhibit the spring member 7 from moving in the falling direction of the take-up reel 5 when the take-up reel 5 tries to move in the direction to fall from the rotary shaft 15*a*.

The spring engaging portion 15*c* includes the concave notch, the open end of the concave notch is provided with the guide portion 15*g* having the notch width lager than a notch width of the bottom portion 15*f* of the notch, and the spring member 7 is engaged with the spring engaging portion 15*c* through the guide portion 15*g* of the spring engaging portion 15*c*, whereby the spring member 7 can be easily engaged with the spring engaging portion 15*c* by the guide portion 15*g* so provided as to have the notch width lager than a notch width of the bottom portion 15*f* of the notch when the first end 7*a* of the spring member 7 is engaged with the concave notch of the spring engaging portion 15*c*.

According to the embodiment, as hereinabove described, the thermal transfer printer further comprises the motor bracket 15 mounted with the paper feed motor 16 driving the take-up reel 5 and including the spring engaging portion 15*c* and the shaft fixing portion 15*h* mounted with the first end 15*b* of the rotary shaft 15*a*, whereby the motor bracket 15 can be used as a member for mounting the rotary shaft 15*a* and the first end 7*a* of the spring member 7. Thus, no members for mounting the rotary shaft 15*a* and for mounting the first end 7*a* of the spring member 7 may be separately provided.

According to the embodiment, as hereinabove described, the U-shaped first end 7*a* of the spring member 7 is inserted into the notch of the spring engaging portion 15*c* provided on the wall surface portion 15*d* of the motor bracket 15 and thereafter the forward end is engaged so as to be hooked onto the upper edge 15*e* of the wall surface portion 15*d*, whereby the first end 7*a* of the spring member 7 can be easily engaged with the motor bracket 15.

According to the embodiment, as hereinabove described, the interval L1 between the bent portion 7*b* and the bent portion 7*c* is formed to be substantially equal to the interval L2 between the bottom portion 15*f* of the notch of the motor bracket 15 and the upper edge 15*e* of the wall surface portion 15*d*, whereby a portion from the bent portion 7*b* of the spring member 7 to the bent portion 7*c* can be brought in close contact with a portion from the bottom portion 15*f* of the notch of the motor bracket 15 to the upper edge 15*e* and the portion from the bent portion 7*c* to the forward end can be mounted so as to be hooked onto the edge 15*e*. Thus, the first end 7*a* of the spring member 7 can be inhibited from wobbling with respect to the motor bracket 15.

According to the embodiment, as hereinabove described, the spring engaging portion 15*c* is provided on a wall surface portion 15*d* extending in the direction intersecting with the direction in which the first end 7*a* of the spring member 7 protrudes from the take-up reel 5, whereby the U-shaped first end 7*a* of the spring member 7 can be easily engaged so as to be hooked onto the wall surface portion 15*d*.

According to the embodiment, as hereinabove described, the guide portion 15*g* is so formed that the notch width is gradually increased from the bottom portion 15*f* of the notch to the open end of the notch, whereby the first end 7*a* of the spring member 7 inserted into the open end with the large notch width is guided by the guide portion 15*g* to reach the bottom portion 15*f* with the small notch width. Thus, the spring member 7 can be easily engaged with the spring engaging portion 15*c*.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary image generating apparatus, the present invention is not restricted to this but is also applicable to another image generating apparatus comprising a take-up reel other than the thermal transfer printer.

According to the embodiment, while the rib 55*c* is provided on the end of the spring mount portion 55*b* of the clutch plate 55 closer to the motor bracket 15 in the aforementioned embodiment, the present invention is not restricted to this but may alternatively be provided on another portion other than the end as far as the portion is closer to the motor bracket (fixing member) than the spring member.

According to the embodiment, while the circumferential rib 55*c* is provided on the spring mount portion 55*b* as a stop portion in the aforementioned embodiment, the present invention is not restricted to this but a structure, in which the spring member is inhibited from falling from the take-up reel, other than the circumferential rib may be alternatively employed. For example, a plurality of ribs may be alternatively provided at prescribed intervals along the outer circumference of the spring mount portion, or a boss other than the rib may be also provided.

According to the embodiment, while the first end 7*a* of the spring member 7 is formed in a U-shape and engaged with the spring engaging portion 15*c* constituted by the notch of the motor bracket 15, the present invention is not restricted to this but the first end of the spring member may be alternatively formed in a L-shape to be engaged with the hole-shaped spring engaging portion of the motor bracket, for example.

According to the embodiment, while the motor bracket 15 is provided with the spring engaging portion 15*c* and the shaft fixing portion 15*h*, the present invention is not restricted to this but the spring engaging portion 15*c* and the shaft fixing portion 15*h* may be alternatively provided on other members, respectively.

What is claimed is:

1. An image generating apparatus comprising:

a take-up member for taking up an ink sheet, including a spring mount portion;

a shaft onto which said take-up member is rotatably mounted, said shaft being fixed not to rotate;

a spring member for regulating said take-up member to rotate only in a take-up direction, mounted on said spring mount portion of said take-up member; and a spring engaging portion engaged with a first end of said spring member;

wherein said spring mount portion of said take-up member is integrally provided with a stop portion for inhibiting said spring member from falling;

wherein said take-up member further includes:

a gear member rotated by driving force of a motor;

a rotating member for taking up said ink sheet by rotation following rotation of said gear member;

a first intervening member arranged between said gear member and said rotating member in order to interrupt transmission of rotation of said gear member to said rotating member in a case where a prescribed load torque or more is applied to said rotating member; and a second intervening member arranged at a position between said gear member and said spring mount portion in order to interrupt transmission of rotation of said gear member to said spring mount portion integrally rotated with said rotating member when a load torque at or above a prescribed load torque is applied to said rotating member; and wherein said gear member, said rotating member and said first intervening member constitute a torque limiter, and said spring mount portion is so formed as to integrally rotate with said gear member.

2. The image generating apparatus according to claim 1, wherein a first end of said shaft is fixedly mounted on a shaft fixing portion; and said stop portion of said spring mount portion includes a circumferential rib provided on an outer circumference of said spring mount portion of said take-up member closer to said shaft fixing portion.

3. The image generating apparatus according to claim 1, wherein said first end of said spring member is formed in a U-shape, and said U-shaped first end of said spring member is engaged so as to be hooked onto said spring engaging portion.

4. The image generating apparatus according to claim 3, wherein said spring engaging portion includes a concave notch, an open end of said concave notch is provided with a guide portion having a notch width larger than a notch width of a bottom portion of said notch, and said spring member is engaged with said spring engaging portion through said guide portion of said spring engaging portion.

5. The image generating apparatus according to claim 4, wherein said guide portion is so formed that a notch width is gradually increased from said bottom portion of said notch toward said open end of said notch.

6. The image generating apparatus according to claim 1, further comprising:

a motor driving said take-up member; and a motor bracket mounted with said motor and including said spring engaging portion and a shaft fixing portion, wherein a first end of said shaft is fixedly mounted on said shaft fixing portion.

7. The image generating apparatus according to claim 6, wherein said spring engaging portion includes an edge portion of said motor bracket, said first end of said spring member is formed in a U-shape, and said U-shaped first end of said spring member is inserted into a notch of said spring engaging portion provided in said motor bracket, while a forward end is engaged so as to be hooked onto said edge portion of said motor bracket.

8. The image generating apparatus according to claim 6, wherein said first end of said spring member is bent at two points of a first bent portion and a second bent portion closer to a forward end than said first bent portion to be formed in a U-shape, and an interval between said first bent portion and said second bent portion is formed to be substantially equal to an interval between a notch of said motor bracket and said edge portion.

9. The image generating apparatus according to claim 6, wherein said first end of said spring member is formed in a U-shape, said U-shaped first end of said spring member is engaged so as to be hooked onto said spring engaging portion, said motor bracket includes a wall surface portion extending in a direction intersecting with a direction in which said first end of said spring member protrudes from said take-up member, and said spring engaging portion is provided in said wall surface portion.

10. An image generating apparatus comprising:

a take-up member for taking up an ink sheet, including a spring mount portion;

a shaft onto which said take-up member is rotatably mounted, said shaft being fixed not to rotate;

a spring member for regulating said take-up member to rotate only in a take-up direction, mounted on said spring mount portion of said take-up member;

a spring engaging portion engaged with a first end of said spring member;

a motor driving said take-up member; and a motor bracket mounted with said motor;

wherein said spring mount portion of said take-up member is integrally provided with a stop portion for inhibiting said spring member from falling, a first end of said shaft is fixedly mounted on a shaft fixing portion, said stop portion of said spring mount portion includes a circumferential rib provided on an outer circumference of said spring mount portion of said take-up member closer to said shaft fixing portion, said motor bracket includes said spring engaging portion and said shaft fixing portion, said first end of said spring member is formed in a U-shape, said U-shaped first end of said spring member is engaged so as to be hooked onto said spring engaging portion of said motor bracket, said spring engaging portion of said motor bracket includes a concave notch, and an open end of said concave notch is provided with a guide portion having a notch width larger than a notch width of a bottom portion of said notch, and said U-shaped first end of said spring member is engaged with said concave notch through said guide portion of said concave notch of said motor bracket;

wherein said take-up member further includes:

a gear member rotated by driving force of said motor;

a rotating member for taking up said ink sheet by rotation following rotation of said gear member;

a first intervening member arranged between said gear member and said rotating member in order to interrupt transmission of the rotation of said gear member to said rotating member in a case where a prescribed load torque or more is applied to said rotating member; and a second intervening member arranged at a position between said gear member and said spring mount portion in order to interrupt transmission of rotation of said gear member said mount portion integrally rotated with said rotating member when a load torque at or above a prescribed load torque is applied to said rotating member; and wherein said gear member, said rotating member and said first intervening member constitute a torque limiter, and said spring mount portion is so formed as to integrally rotate with said gear member.

11. The image generating apparatus according to claim 10, wherein said spring engaging portion includes an edge portion of said motor bracket, and said U-shaped first end of said spring member is inserted into said notch of said spring engaging portion provided in said motor bracket, while a forward end is engaged so as to be hooked onto said edge portion of said motor bracket.

12. The image generating apparatus according to claim 10, wherein said first end of said spring member is bent at two points of a first bent portion and a second bent portion closer to a forward end than said first bent portion to be formed in a U-shape, and an interval between said first bent portion and said second bent portion is formed to be substantially equal to an interval between said notch of said motor bracket and said edge portion.

13. The image generating apparatus according to claim 10, wherein said motor bracket includes a wall surface portion extending in a direction intersecting with a direction in which said first end of said spring member protrudes from said take-up member, and said spring engaging portion is provided in said wall surface portion.

14. The image generating apparatus according to claim 10, wherein said guide portion is so formed that a notch width is gradually increased from said bottom portion of said notch toward said open end of said notch.

* * * * *